US005551209A

United States Patent [19]

Molina et al.

[11] Patent Number: 5,551,209

[45] Date of Patent: Sep. 3, 1996

[54] PRODUCTION LINE FOR PACKAGING ROWS OR LAYERS OF PRODUCTS AND PRODUCTION LINE RECYCLING DEVICE

[75] Inventors: Ernest Molina, Daillens; Alexis Chenevard, Morges, both of Switzerland

[73] Assignee: Sapal Societe Anonyme Des Plieuses Automatiques, Ecublens, Switzerland

[21] Appl. No.: 409,531

[22] Filed: Mar. 24, 1995

[30] Foreign Application Priority Data

Mar. 31, 1994 [FR] France ..... 94 04090

[51] Int. Cl.[6] ..... B65B 41/18

[52] U.S. Cl. ..... 53/168; 198/449; 198/444

[58] Field of Search ..... 53/168; 198/444, 198/448, 449

[56] References Cited

U.S. PATENT DOCUMENTS

| | | | |
|---|---|---|---|
| 3,339,701 | 9/1967 | Weichand | 198/449 |
| 3,944,049 | 3/1976 | Graybill | 198/444 |
| 3,952,855 | 4/1976 | Rogers | 198/449 |
| 5,094,337 | 3/1992 | van Veldhuisen et al. | 198/448 |
| 5,113,639 | 5/1992 | Bryson | 53/168 |
| 5,161,665 | 11/1992 | Cragun | 198/448 |

*Primary Examiner*—John Sipos
*Assistant Examiner*—Gene L. Kim
*Attorney, Agent, or Firm*—Davis, Bujold & Streck, P.A.

[57] ABSTRACT

The present invention concerns a production line for rows or layers of products, especially food products and more specifically, confectionery products such as chocolate wafers, bars, or the like, comprising a recycling device for the timed reintroduction of the temporarily stored products into the empty spaces between the products on said conveyor belts.

The recycling device (13) comprises a first endless conveyor belt, called the recycling belt (18), mounted on a pivoting support, and a second endless conveyor belt, called the switching belt (19), also mounted on a pivoting support, said switching belt (19) being positioned either in the extension of the recycling belt (18) or inserted between two conveyor belts (10) on the line, and the recycling belt (18) being positioned either in the extension of the switching belt (19) or in the extension of the conveyor belt of the storage device (14).

6 Claims, 3 Drawing Sheets

Figure 1:
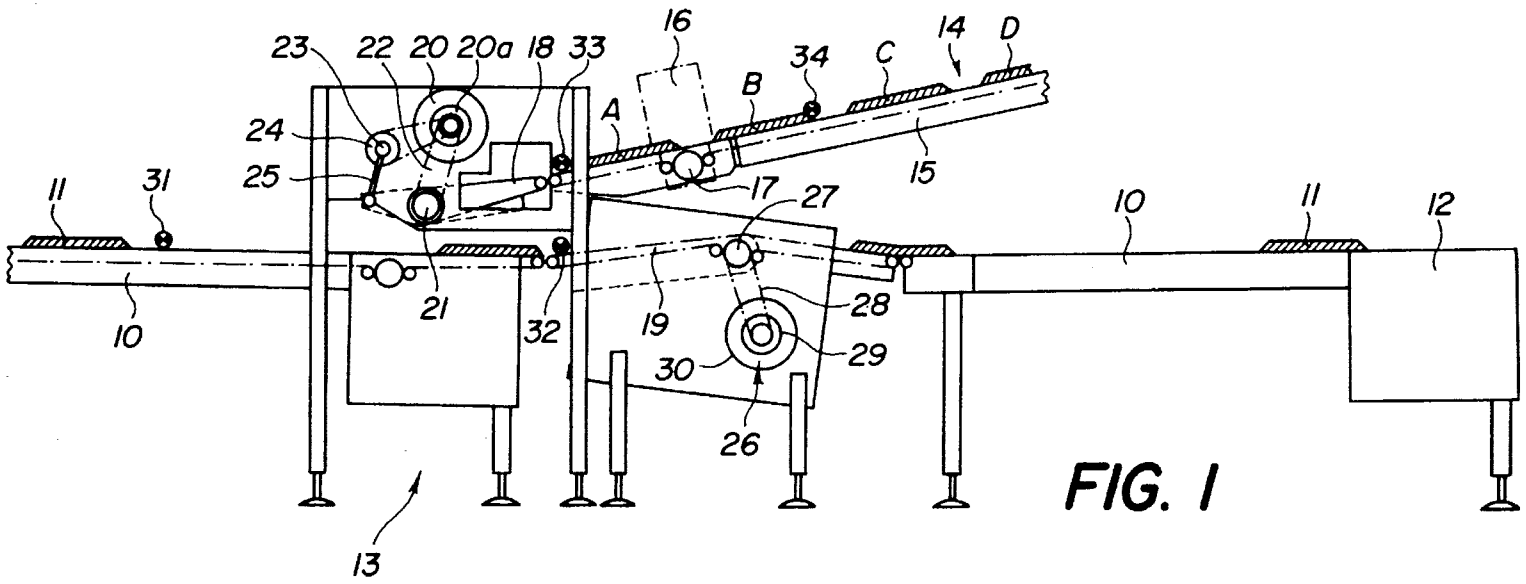

PRODUCTION LINE FOR PACKAGING ROWS OR LAYERS OF PRODUCTS AND PRODUCTION LINE RECYCLING DEVICE

The present invention concerns a production line for packaging rows or layers of products, especially food products and more specifically, confectionery products such as chocolate wafers, bars or the like, said line comprising several wrapping stations and conveyor belts which supply those stations, as well as at least one storage device with at least one endless belt for temporarily storing rows or layers of said products, and a recycling device for the timed reintroduction of the temporarily stored products into the empty spaces between the products on said conveyor belts.

It also concerns a recycling device for the timed reintroduction of the temporarily stored products into the empty spaces between the products on the conveyor belts which supply the wrapping stations on a line for packaging rows or layers of products, especially food products and more specifically, confectionery products such as chocolate wafers, bars or the like, said line being equipped with at least one storage device.

Equipment for recycling stored products and reinjecting the products onto the supply belts of a production line is known in the art. Such equipment is described, for example, in Swiss Patent No. 621 305. Products proceed along supply belts on an automatic packaging line and are successively deflected from the belts and picked up by the packaging units. This procedure creates "holes" in the rows of products, which can be used for recycling temporarily stored products. For various reasons, products may be stored and then reintroduced onto the line, specifically, into the "holes" or empty spaces on the supply belts.

When the products are fragile, particularly delicate food products such as molded chocolate wafers arranged in rows or small products such as patties, either chocolate covered or not, and arranged in layers to be globally processed, that is, not one row at a time but in groups of rows, a transfer system which pushes products from one belt to another is not effective, particularly at high speeds. Therefore, it is necessary to develop a means for positively accompanying the products, during every displacement, which does not exert friction at the level where the products are supported.

The present invention proposes a means for effectively transferring either rows or entire layers of products from the storage area onto the supply belts of a packaging line at very high speeds.

To achieve this, the packaging line according to the invention is characterized in that said recycling device has a first endless belt, called the recycling belt, mounted on a pivoting support, and a second endless belt, called the switching belt, also mounted on a pivoting support, said switching belt being positioned either in the extension of the recycling belt or inserted between two conveyor belts on the line, and the recycling belt being positioned either in the extension of the switching belt or in the extension of the conveyor belt on the storage device.

To achieve this, the recycling device of the invention is characterized in that it comprises a first endless conveyor belt called the recycling belt, mounted on a pivoting support, and a second endless conveyor belt called the switching belt, also mounted on a pivoting support, with the switching belt being positioned either in the extension of the recycling belt or inserted between two conveyor belts on the line, and the recycling belt being positioned either in the extension of the switching belt or in the extension of the conveyor belt of the storage device.

In the preferred embodiment of the invention the pivoting support for the recycling belt is associated with an actuation means comprising a connecting rod, one end of which is attached to said support and the other end of which is activated by at least one rotating cam, as well as a drive motor connected to said cam.

In this embodiment there may also be provided an indexing cam driven by the drive motor, which cam increments the number of rotations and controls advancement of the recycling belt.

The pivoting support for the switching belt is preferably associated with at least one positioning cam designed to control a mechanism which positions said support.

The device preferably comprises at least one product sensor situated at the entry to the switching belt.

The present invention will be better understood with reference to the description of one preferred embodiment, provided by way of non-limiting example, and to the attached drawings, in which:

FIGS. 1 through 5 are partial schematic views of the packaging line and the recycling device according to the invention, with the device functioning in various phases.

The line, which is partially shown, comprises several conveyor belts 10 designed to transport products 11, which are preferably fragile food products such as chocolate wafers or bars, arranged in rows or in layers, and to direct them to several wrapping stations 12 spaced apart along the line. A recycling device 13 is located between two conveyor belts 10 to cooperate with a storage device 14 for temporarily storing products 11, which will then be reintroduced via the recycling device onto belts 10 on the line. There are always empty spaces between the products 11 being transported by these belts.

Storage device 14 comprises at least one endless conveyor belt 15, with a drive motor 16 connected to a drive shaft 17 for driving the belt. In the example shown, products A, B, C and D are stored on this device.

Recycling device 13 consists of a recycling belt 18 and a switching belt 19 both mounted on pivoting supports. Recycling belt 18 may occupy a raised position in which it is located in the extension of endless conveyor belt 15 or a lowered position in which it may be located in the extension of switching belt 19. Switching belt 19 may also occupy two positions, namely a raised position in which it may be located in the extension of recycling belt 18 if the latter is in the lower position, and a lower position in which it is generally located within the extension of conveyor belts 10, allowing products A, B, C and D to pass directly to wrapping stations 12.

Recycling belt 18 is driven by drive motor 20 using a drive roller 21 connected to motor 20 by a drive belt 22. The same motor drives at least one and preferably two cams 23, 24 designed to cooperate with a connecting rod 25 which defines the support position for recycling belt 18 and determines whether it is in the raised or lowered position.

In addition, this motor drives an index cam **20*a* mounted directly on the motor shaft which increments the number of rotations and determines the corresponding advancement of recycling belt 18**.

Switching belt 19 is driven by drive motor 26 via a roller 27 connected to this motor by a drive belt 28. This motor 26 also drives at least one and preferably two positioning cams 29 and 30, which determine the raised or lowered position of recycling belt 18, for example, by using a connecting rod (not shown).

It is apparent that other means such as a hydraulic or pneumatic cylinder, or servomotors, could be used to define the position of the two pivoting supports for recycling belt 18 and switching belt 19.

Several photoelectric cells 31, 32, 33 and 34 are provided on the line to indicate the presence or absence of products and thereby control various other elements of the line. Cell 31 is associated with conveyor belt 10 to detect the presence of products 11. Cell 32 is located at the entrance to the switching belt 19 to detect the presence or absence of products at this location. Cell 33 is located at the entrance to storage device 14 and cell 34 is mounted downstream thereof on this device. These two cells simultaneously indicate the presence or absence of products and their position in relation to the extremity which cooperates with the recycling belt.

When the belts are in the recycling and switching position shown in FIG. 1, products 11 led by conveyor 10 (on the left in the drawing) move along the switching belt 19, in lowered position, toward belt 10 (on the right in the drawing). Recycling belt 18 is at rest and products A, B, C and D are stationary on the endless conveyor belt 15.

Figure 2:
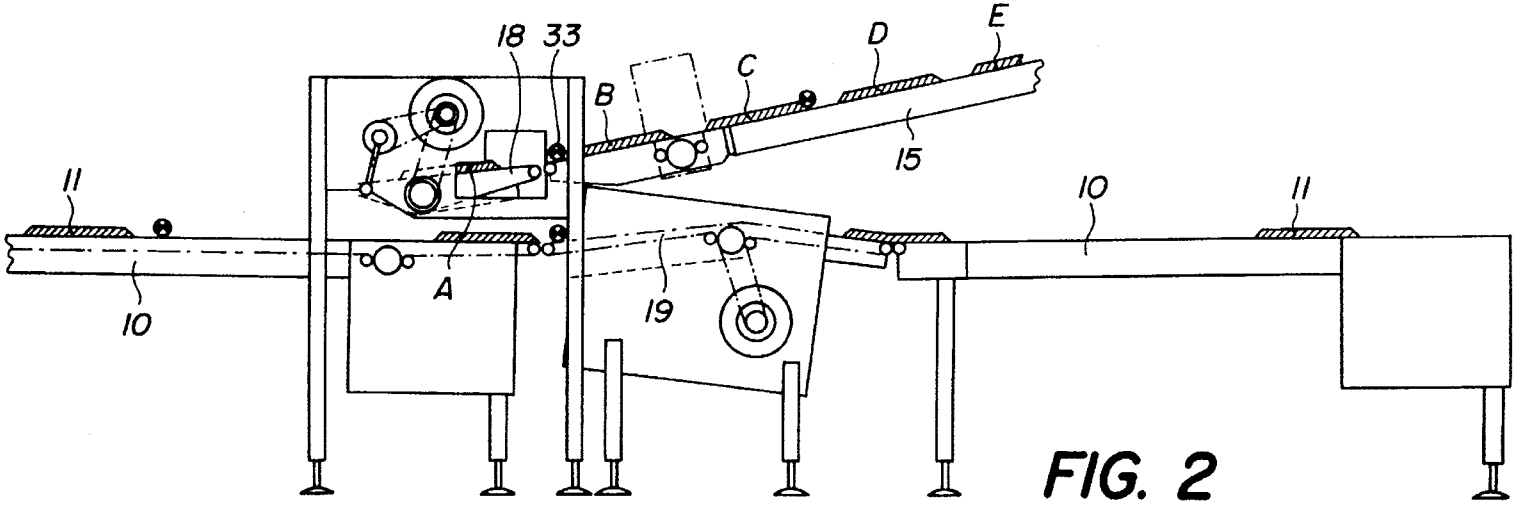

In the position shown in FIG. 2, products 11 continue in their path on belts 10, but product A is transferred from endless belt 15 to the waiting position on recycling belt 18, which is maintained in raised position. Cell 33 has detected the passage of product A and stops the movement of belt 15 when product B arrives.

Figure 3:
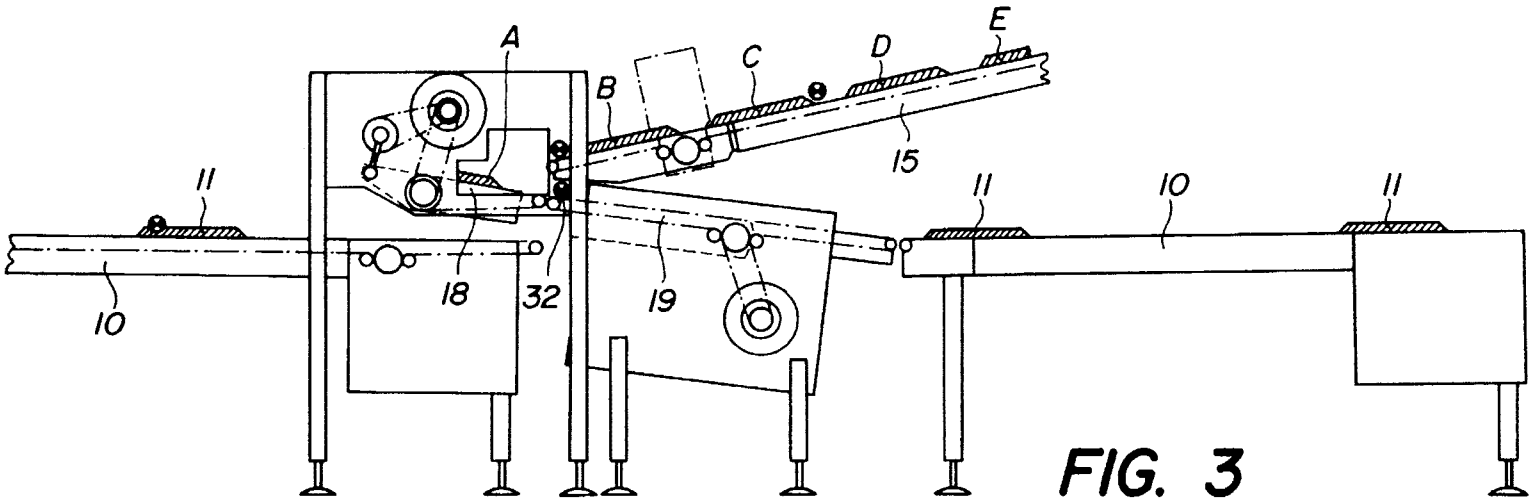

FIG. 3 illustrates a phase during which the recycling belt 18 is in the lowered position and the switching belt 19 is in the raised position. Product A, previously placed in the waiting position on recycling belt 18, can be transferred to the switching belt 19. Sensor 32 emits a signal indicating that the product has passed through.

Figure 4:
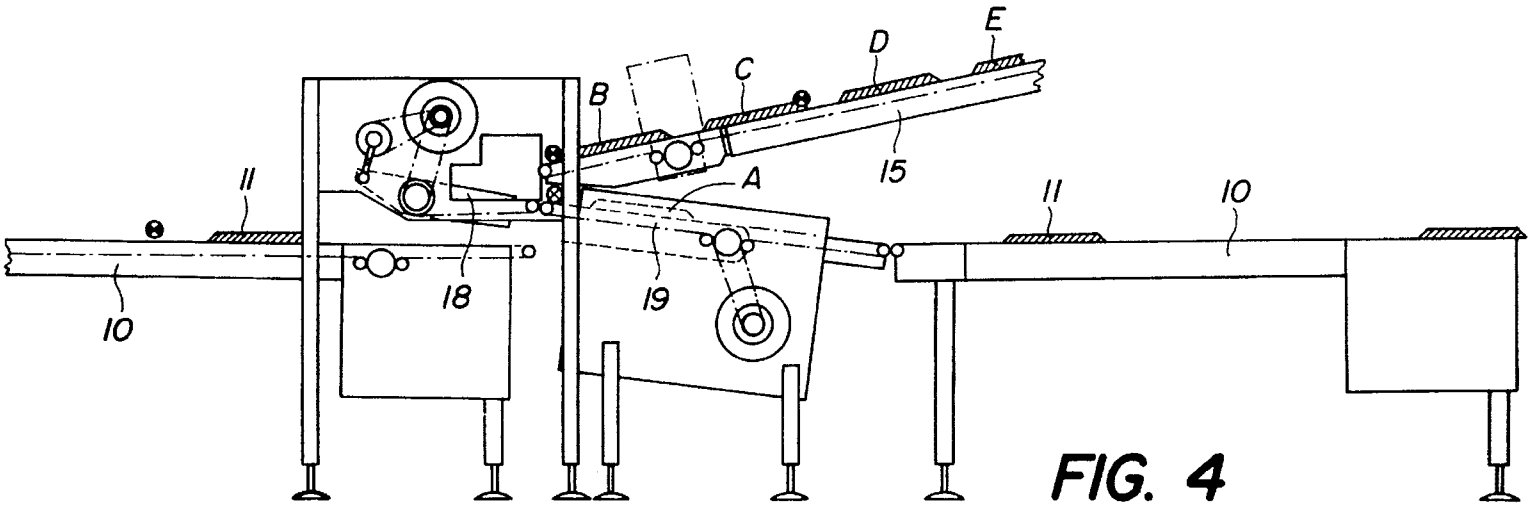

FIG. 4 shows the passage of product A onto the switching belt 19, with the recycling and switching belts remaining in the same position as shown in FIG. 3.

Figure 5:
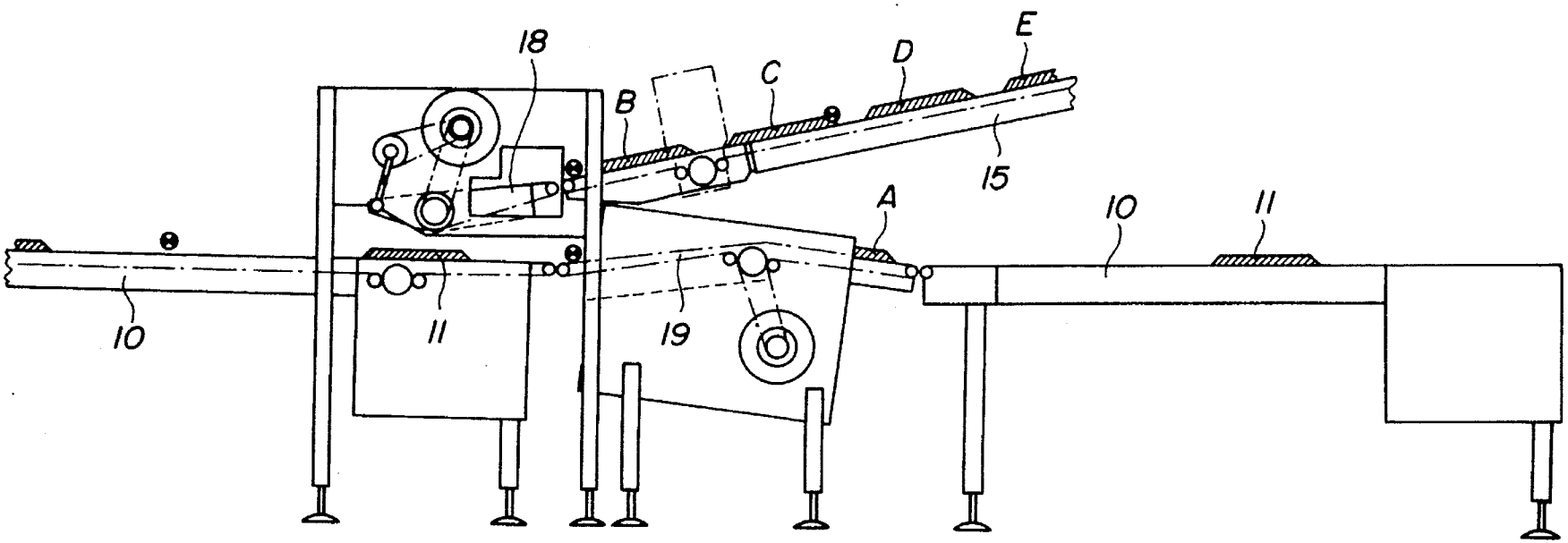

FIG. 5 shows the phase during which product A is inserted or reintroduced into the line, more specifically, onto belts 10, in the space or "hole" separating two products 11. The recycling belt 18 and switching belt 19 resume their initial position, with the result that product B, normally stored on the conveyor belt 15, can be placed in the waiting position on the recycling belt.

The recycling belt is particularly significant; since it effectively accompanies the products during each displacement. This is important when rows or layers of products are involved, particularly those that are small and lightweight, as they can be easily toppled and disarranged when passing from one conveyor or from one belt to another. Furthermore, the device constitutes an independent unit that is easily incorporated into an existing line.

The present invention is not limited to the embodiments described above, but may undergo various modifications and variations obvious to one skilled in the art.

We claim:

1. A production line for packaging products (A, B, C, D) comprising one of products arranged in rows, products stacked in layers, and delicate food products, said line comprising a plurality of wrapping stations (12) and endless conveyor supply belts (10) which supply the wrapping stations with said products, at least one storage device (14) having at least one endless conveyor storage belt (15) for temporarily storing said products, and a recycling device (13) for timed re-introduction of the temporarily stored products (A, B, C, D) into empty spaces between the products on the conveyor belts (10), wherein said recycling device (13) comprises;

an endless conveyor recycling belt (18) mounted on a pivoting support for pivotal motion between a raised position in which the recycling belt (18) is located in an extension of the storage belt (15), and a lowered position; and an endless conveyor switching belt (19) mounted on a pivoting support for pivotal motion between a raised position, in which the switching belt (19) is located in an extension of the recycling belt (18) when the recycling belt (18) is located in the lowered position, and a lowered position in which the switching belt (19) is located between two said supply belts (10) in an extension of said two supply belts;

wherein, when the switching belt (19) is in the raised position and the recycling belt (18) is in the lowered position, the recycling belt (18) and the switching belt (19) are driven at the same speed, such that said products are transferred between the switching belt (19) and the recycling belt (18) without any friction between the products and said belts, and when the switching belt (19) is in the lowered position and the recycling belt (18) is in the raised position said products are transferred between the switching belt (19) and the supply belts (10) and between the recycling belt (18) and the storage belt (15) without friction between the products and the belts.

2. A recycling device for the timed re-introduction of products, comprising one of products arranged in rows, products stacked in layers and delicate food products, which have been temporarily stored on an endless storage conveyor belt, into empty spaces between said products on endless conveyor supply belts for supplying said products to wrapping stations on a packaging line, wherein said recycling device comprises;

an endless conveyor recycling belt (18), mounted on a pivoting support, and an endless conveyor switching belt (19), mounted on a pivoting support;

wherein the recycling belt (18) is mounted for pivotal motion between a raised position, in which the recycling belt (18) is located in an extension of the endless conveyor storage belt, and a lowered position, and the switching belt (19) is mounted for pivotal motion between a raised position, in which the switching belt (19) is located in an extension of the recycling belt (18) when the recycling belt (18) is located in the lowered position, and a lowered position in which the switching belt (19) is located in an extension of the supply belts, for transfer of the products from one belt to another without friction.

3. A device according to claim 2 characterized in that the pivoting support for the recycling belt (18) is associated with an actuation device consisting of a connecting rod (25), one end of which is attached to said support and the other end of which is activated by at least one rotating cam (23), as well as a drive motor (20) coupled with said cam.

4. A device according to claim 3 characterized in that it comprises an indexing cam (20*a*) driven by said drive motor, which cam increments the number of rotations and determines the advancement of the recycling belt (18).

5. A device according to claim 2 characterized in that the pivoting support for the switching belt (19) is associated with at least one positioning cam (29) which controls a mechanism that positions said support.

6. A device according to claim 2 characterized in that it comprises at least one sensor (32) of products (11) located at the entry to the switching belt (19).

* * * * *